US006922963B2

(12) United States Patent
Simonelli et al.

(10) Patent No.: US 6,922,963 B2
(45) Date of Patent: Aug. 2, 2005

(54) MOISTURE AND CONDENSATION BARRIER FOR BUILDING STRUCTURES

(75) Inventors: Peter Simonelli, Northglenn, CO (US); Michael Simonelli, Dupont, CO (US)

(73) Assignee: Bondo Corporation, Atlanta, GA (US)

( * ) Notice: Subject to any disclaimer, the term of this patent is extended or adjusted under 35 U.S.C. 154(b) by 227 days.

(21) Appl. No.: 09/874,801

(22) Filed: Jun. 5, 2001

(65) Prior Publication Data

US 2001/0049917 A1 Dec. 13, 2001

Related U.S. Application Data

(60) Provisional application No. 60/208,932, filed on Jun. 5, 2000.

(51) Int. Cl.[7] ..... E04F 15/22

(52) U.S. Cl. ..... 52/480; 52/403.1; 52/310; 52/390; 237/69; 165/49

(58) Field of Search ..... 52/310, 386, 390–392, 52/403.1, 480, 408–409, 223.3, 223.6; 237/69; 165/49, 168

(56) References Cited

U.S. PATENT DOCUMENTS

| | | | | |
|---|---|---|---|---|
| 865,651 A | * | 9/1907 | Mauran | 237/69 |
| 1,403,142 A | | 1/1922 | Atwood et al. | |
| 1,819,147 A | | 8/1931 | Bronson | |
| 2,149,026 A | | 2/1939 | McBride | |
| 2,875,101 A | | 2/1959 | Ehrlich | |
| 3,189,514 A | | 6/1965 | Shriver et al. | |
| 3,505,770 A | | 4/1970 | Bennett | |
| 3,518,800 A | * | 7/1970 | Tank | 52/480 |
| 3,579,941 A | | 5/1971 | Tibbals | |
| 3,619,964 A | | 11/1971 | Passaro et al. | |
| 3,770,536 A | | 11/1973 | Haigh | |
| 3,962,168 A | | 6/1976 | Edwards | |
| 3,969,558 A | | 7/1976 | Sadashige | |
| 4,019,922 A | | 4/1977 | Whittum et al. | |
| 4,076,569 A | | 2/1978 | Buchbinder | |
| 4,109,041 A | | 8/1978 | Tellman | |
| 4,117,305 A | | 9/1978 | Colten | |
| 4,204,106 A | | 5/1980 | Colten | |
| 4,242,390 A | | 12/1980 | Nemeth | |
| 4,449,342 A | * | 5/1984 | Abendroth | 52/393 |
| 4,480,175 A | | 10/1984 | Brasky | |
| 4,562,103 A | | 12/1985 | Hering | |
| 4,644,720 A | * | 2/1987 | Schneider | 52/392 |
| 4,677,801 A | | 7/1987 | Bard | |
| 4,690,848 A | | 9/1987 | Hering | |
| 4,699,834 A | | 10/1987 | Schiffer | |
| 4,798,364 A | | 1/1989 | Scott | |
| 4,910,936 A | * | 3/1990 | Abendroth et al. | 52/403.1 |
| 4,952,775 A | | 8/1990 | Yok yama et al. | |
| 5,137,764 A | | 8/1992 | Doyle et al. | |
| 5,454,428 A | | 10/1995 | Pickard et al. | |
| 5,464,680 A | | 11/1995 | Hauser et al. | |
| 5,497,590 A | * | 3/1996 | Counihan | 52/385 |
| 5,510,198 A | | 4/1996 | Maag et al. | |
| 5,879,491 A | | 3/1999 | Kobayashi | |
| 6,136,408 A | * | 10/2000 | Radcliffe et al. | 428/107 |
| 6,179,942 B1 | * | 1/2001 | Padmanabhan | 156/153 |
| 6,189,279 B1 | | 2/2001 | Fiechtl | |
| 6,224,700 B1 | | 5/2001 | Oakley | |
| 6,231,994 B1 | | 5/2001 | Totten | |

FOREIGN PATENT DOCUMENTS

| | | |
|---|---|---|
| DE | 2807316 | 8/1979 |
| DE | 19520567 | * 12/1996 |
| GB | 409388 | 5/1934 |
| JP | 7-268970 | * 10/1995 |
| JP | 10-237980 | * 9/1998 |
| JP | 11-293807 | * 10/1999 |

* cited by examiner

*Primary Examiner*—Winnie Yip
(74) *Attorney, Agent, or Firm*—Calfee, Halter & Griswold LLP

(57) ABSTRACT

Moisture and condensation barriers for protecting wood from damage in building structures (particularly but not necessarily in flooring systems) include a liquid rubberized coating material coated onto some of the wood or a barrier sheet having a petroleum-based tar layer.

12 Claims, 8 Drawing Sheets

MOISTURE AND CONDENSATION BARRIER FOR BUILDING STRUCTURES

CROSS-REFERENCE TO RELATED APPLICATION

This application is related to, and claims the benefit of, a previously filed U.S. provisional patent application, titled "Moisture and Condensation Barrier for Hardwood Floors Constructed over Wood Subfloor and Radiant Heating Systems," application number 60/208,932, filed Jun. 5, 2000, by one of the present inventors.

FIELD

The subject matter herein relates to moisture and condensation barriers, particularly (but not necessarily) for flooring systems installed in building structures.

BACKGROUND

Moisture is known to cause warping, cracking, buckling, rotting and other damage to wood building materials and can create an environment for the growth of mold, mildew and termites in or on the wood. Such moisture may come up from under a building structure from ground water, through the sides, top and bottom from precipitation and directly out of the air as condensation. Moisture and condensation have been a particular problem in building structures having radiant heating systems, since frequent cycling on and off of the radiant heating systems causes moisture condensation around the radiant heating systems. Various types of barriers to moisture and condensation have been developed to prevent damage to the building structures, particularly to wood flooring systems in the building structures.

Many moisture and condensation prevention and/or barrier techniques have been attempted. However, particularly for flooring systems that have a radiant heating system, an appropriate material that provides a sufficient moisture and condensation barrier and that does not degrade over time or with repeated heating and cooling or with exposure to moisture has not been discovered. Additionally, the moisture and condensation barrier techniques typically require complicated and time-consuming installation procedures.

Barrier materials that have been tried include a flexible sheet (single-ply or multi-ply) that is laid (with or without adhesive) between layers of the building structure, such as between layers of the flooring system. The sheet may be made of a polymeric sheet, thermoplastic film, a polymer film, polyethylene, polyvinylchloride, polyurethane, polypropylene, a vinyl film and the like.

Other attempted barrier materials have included a liquid that is placed on top of or sprayed or painted on the side of one or more of the layers of the building structure and allowed to form into a solid. For example, a water based adhesive, synthetic resin film, polymeric layer, polyolefin, polyethylene, polypropylene, polybutylene, polyvinylchloride, hot mastic asphalt tar, thermoplastic elastomers, styrene, butadiene, copolymers and the like may be coated on top of one of the layers and allowed to cool, dry or cure into a vapor or moisture barrier.

Other barrier materials have been formed into boards (typically with wood and typically laminated) that can be used in constructing some of the layers of the building structure. For example, one or more layers or a sheath or envelope of plastic, thermoplastic, thermoplastic resinous polymers, thermoplastic resins, thermoplastic homopolymers, copolymers, copolyester, terpolymers, vinyl resins, polyvinyl, polyvinyl chloride, polyethylene, polypropylene, polyolefins, polyamides, polyurethane, acrylonitrilebutadiene, acrylic resins, phenolic resins, asphalt impregnated fabric, waxes, vulcanized rubber, vulcanizable rubber or rubber latex (vulcanized or heat-pressed in situ), chlorinated rubber, a methyl methacrylate monomer, a hydroxy alkylacrylate or diacetone acrylamide monomer, a chlorinated hydrocarbon, an antimony compound, a zinc compound and the like may be formed on or in the board. Such coated or laminated boards may be used for the subfloor or the finished floor of the flooring system.

Additionally, coated wood boards for building materials have been developed for purposes other than for moisture barriers. For example, rubber particles have been heat pressed onto a wood board to form a board with a non-skid surface. Additionally, pulverized rubber has been added to styrene acrylate polymers and polyvinyl acetate-acrylic co-polymers and sprayed onto a wood board and allowed to cure to form a resilient and skid resistant surface on the board. Additionally, a rubber based elastomeric material has been heat-pressed onto a laminated board and used to bond the laminated board to a substrate coated with a similar rubber based material.

An exemplary prior art building structure 100 is shown in FIG. 1 as having an exemplary prior art flooring system 102 supported by structural joists, or trusses, 104 which in turn are supported by some type of concrete slab 106 so as to elevate the structural joists 104 and flooring system 102 above the ground 108. The prior art flooring system 102 in this example includes a "finished" hardwood floor 110 above a first wood subfloor 112, which overlays an optional radiant heating system 114 above a second wood subfloor 116, which is supported by the structural joists 104. There are many types of radiant heating systems for flooring, but in this example the optional radiant heating system 114 includes lightweight concrete sections 118 having heat pipes 120 displaced throughout the length of the lightweight concrete sections 118. The radiant heating system 114 keeps the flooring system 102, and consequently the building structure 100, warm during cold temperature seasons.

With or without the radiant heating system 114, moisture and condensation commonly reaches the flooring system 102 through the ground 108 or through the concrete slab 106. The radiant heating system 114 commonly exacerbates the moisture and condensation problem. At least one type of flooring system (not shown) is known to incorporate a waterproof sheet or moisture sealing layer (not shown) under the radiant heating system 114, but this placement of the waterproof sheet cannot solve the problem of condensation around the radiant heating system 114 reaching the wood subfloor 112 and the finished hardwood floor 110.

The moisture and condensation problem is also present in building structures that have concrete slabs that do not elevate the flooring system above the ground, but support the flooring system directly on the ground. In such a building structure, a flooring system was formed on top of a concrete slab supported on the ground. The concrete slab also had a radiant heating system built into it. The flooring system was constructed with 30-lb felt tar paper overlaying the radiant heating concrete slab, a layer of plywood placed over the felt tar paper, a layer of glue troweled over the plywood and a finished hardwood floor fastened to the plywood by the glue and staples. Within a year, the flooring system had warped and buckled, due to moisture, which the felt tar paper and the glue layer could not prevent passing from the radiant heating concrete slab to the plywood and the finished hardwood floor. The flooring system was replaced with a second flooring system constructed with a moisture-resistant two-part epoxy squeegeed over the radiant heating concrete slab followed by the plywood, glue and stapled finished hardwood floor. Within half a year, the second flooring system had also warped and buckled and the epoxy had cracked, flaked and separated from the radiant heating concrete slab, due to moisture.

It is with respect to these and other background considerations that the subject matter herein has evolved.

SUMMARY

The subject matter herein involves the discovery of moisture and condensation barrier materials that do not degrade over time or when exposed to moisture or heating/cooling cycles and that do not require the complex installation procedures required of those materials described in the background. In particular, after the second flooring system described in the background had warped and buckled and the epoxy had cracked, flaked and separated from the radiant heating concrete slab, due to moisture, a third flooring system was installed for testing in the building structure over the radiant heating concrete slab. The third flooring system included a petroleum-based tar sheet (not described in any of the background barrier materials) placed over the radiant heating concrete slab followed by the plywood and the stapled finished hardwood floor (without the glue). After more than a year and a complete seasonal cycle and after more than a hundred other installations of similar flooring systems, particularly over radiant heating systems, the petroleum-based tar sheet has proven to be an effective moisture and condensation barrier that is quick and easy to install. In one embodiment, that product commonly referenced by the trade name "Grace Ice and Water Shield," which is about a 40-mil thick petroleum-based tar product having about a 2-mil thick plastic overlay, has been used effectively.

Additionally, a paintable rubberized coating material (not described in any of the background barrier materials or other coating materials) has been coated onto wood boards and tested as a moisture barrier and proven to be effective and quick and easy to install. In other embodiments, that product commonly referenced by the trade name "Dynatron (™) Dyna-Pro Rubberized Undercoat" (™) and that product commonly referenced by the trade name "Mar-Hyde Paintable Rubber Undercoating" (™) have been used effectively at a thickness of about 6–8 mils. These rubberized undercoatings generally cure into a non-tacky solid.

A more complete appreciation of the present disclosure and its scope, and the manner in which it achieves the above noted improvements, can be obtained by reference to the following detailed description of presently preferred embodiments taken in connection with the accompanying drawings, which are briefly summarized below, and the appended claims.

DETAILED DESCRIPTION

Figure 1:
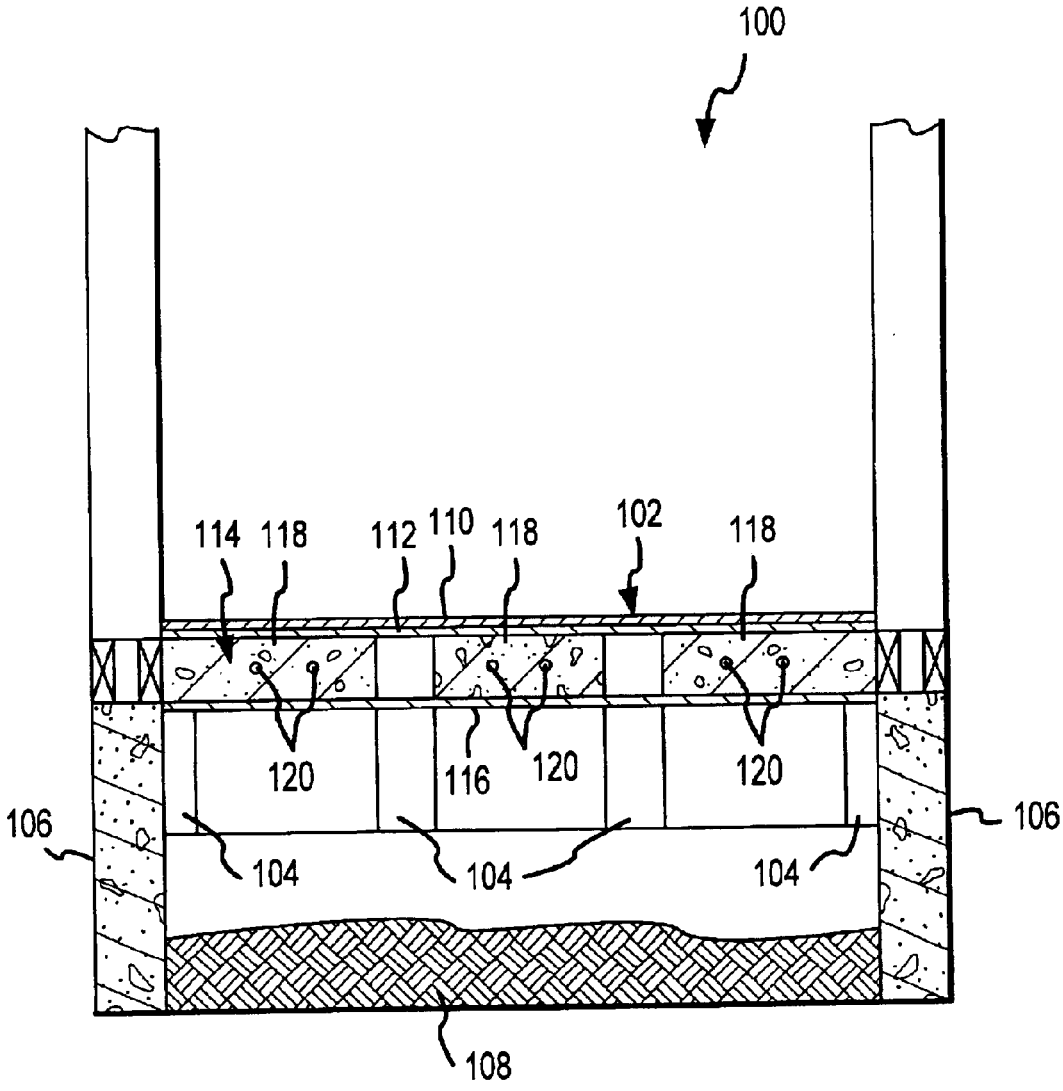
(PRIOR ART) FIG.1
FIG. 1 is a cross sectional view of a prior art building structure including a prior art flooring system.
Figure 2:
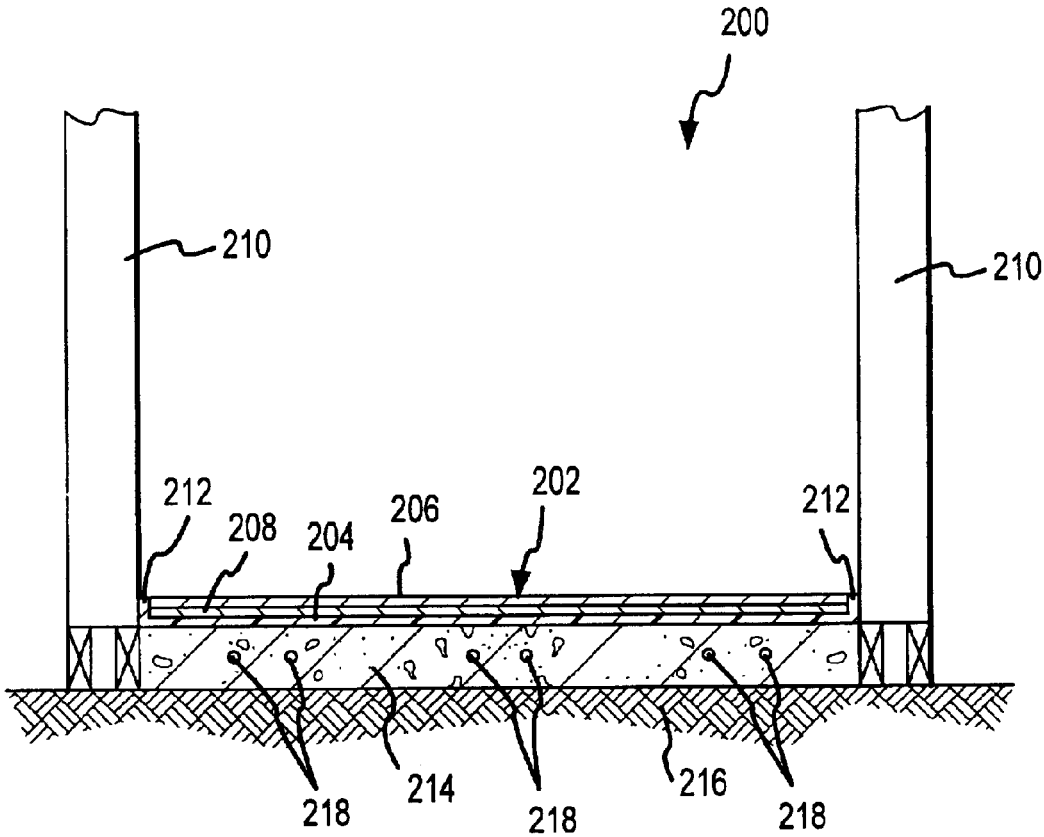
FIG. 2 is a cross sectional view of a building structure including a first embodiment of a flooring system according to the present invention.

A building structure 200 having a first embodiment of a flooring system 202 including an adequate moisture and condensation barrier 204 is shown in FIG. 2. The moisture and condensation barrier 204 generally comprises a sheet of lightweight, durable and flexible material that is impervious to moisture and condensation, such as (but not limited to) a petroleum-based tar sheet. That product commonly referenced by the trade name "Grace Ice and Water Shield" is an example of such a sheet, which is about a 40-mil thick petroleum-based tar product having a 2-mil thick plastic overlay, and is commonly used as a roofing material. After the materials described in the background were shown not to provide a proper moisture and condensation barrier, the Grace Ice and Water Shield was installed in over a hundred building structures and has proven not to be susceptible to degradation due to the presence of moisture or when subjected to heating/cooling cycles (particularly freeze/thaw cycles). In this embodiment, the moisture and condensation barrier 204 is placed beneath a "finished" hardwood floor 206 and a wood subfloor 208 in the flooring system 202 so as to prevent moisture from reaching the hardwood floor 206. The moisture and condensation barrier 204 may be placed with or without an attachment to the wood by chemical adhesion, bonding or other techniques that do not affect, compromise or alter the moisture imperviousness of the material.

The flooring system 202 is placed between walls 210 above a concrete slab on grade 214 supported directly on the ground 216. The edges 212 of the moisture and condensation barrier 204 may be turned up at the walls 210 to a height flush with the top surface of the hardwood floor 206.

The concrete slab on grade 214 also serves as an optional radiant heating system having heat pipes 218 displaced throughout the concrete slab on grade 214. The same flooring system 202 with the moisture and condensation barrier 204 beneath the hardwood floor 206 and the wood subfloor 208 may also be incorporated into a building structure (not shown) having a concrete slab that elevates the flooring system 202 off the ground 216 with or without the radiant heating system.

Figure 3:
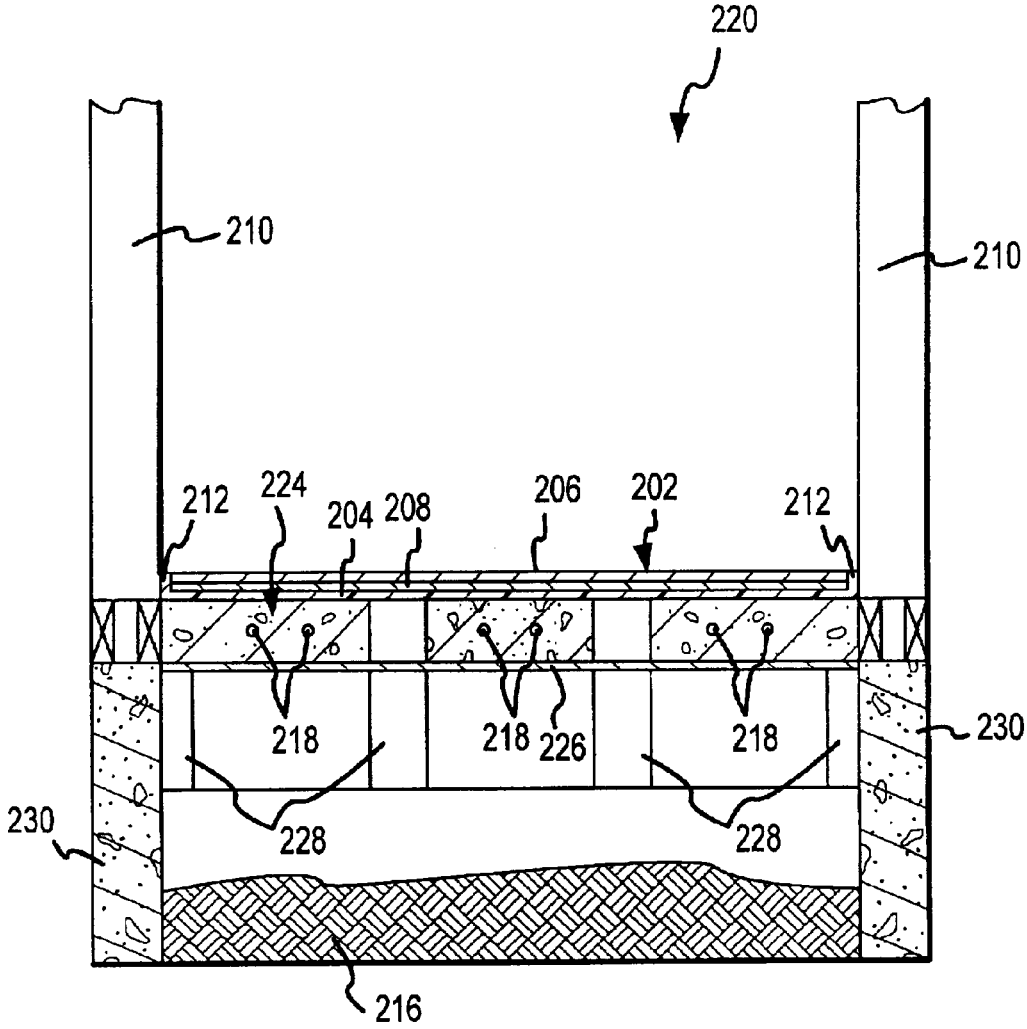
FIG. 3 is a cross sectional view of a building structure including a second embodiment of a flooring system according to the present invention.

A building structure 220 having a second embodiment of the flooring system 202 including an adequate moisture and condensation barrier 204, similar to the moisture and condensation barrier 204 shown in FIG. 2, is shown in FIG. 3. In this embodiment, the moisture and condensation barrier 204 is placed beneath the hardwood floor 206 and the first wood subfloor 208 so as to prevent moisture from reaching the hardwood floor 206 or the first wood subfloor 208. Thus, the moisture and condensation barrier 204 is between the first wood subfloor 208 and an optional radiant heating system 224 (having the heat pipes 218 displaced throughout) placed above a second wood subfloor 226 in the flooring system 202. The edges 212 of the moisture and condensation barrier 204 may be turned up at the walls 210 to a height flush with the top surface of the hardwood floor 206.

The flooring system 202 is placed between the walls 210 and above structural joists, or trusses, 228. The flooring system 202 is supported by the structural joists 228, which in turn are supported by a concrete slab 230, which elevates the structural joists 228 and the flooring system 202 above the ground 232. The same flooring system 202 with the moisture and condensation barrier 204 under the hardwood floor 206 and the wood subfloor 208 may also be incorporated into a building structure (not shown) having a concrete slab that does not elevate the flooring system 202 off the ground 232 with or without the radiant heating system 224.

Figure 4:
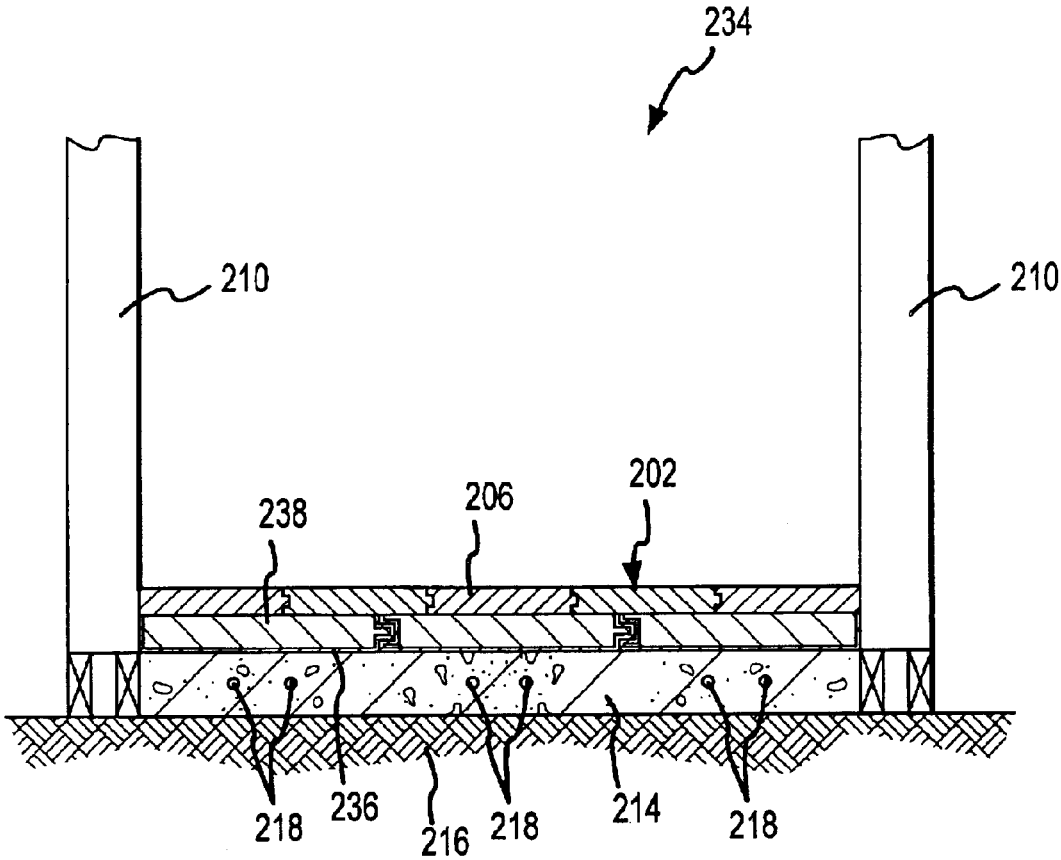
FIG. 4 is a cross sectional view of a building structure including a third embodiment of a flooring system according to the present invention.

A building structure 234 having a third embodiment of the flooring system 202 including an adequate moisture and condensation barrier 236 is shown in FIG. 4. In this embodiment, the moisture and condensation barrier 236 is coated onto wood boards (such as plywood, chipboard, particle board, etc.) that form a wood subfloor 238 under the hardwood floor 206. The moisture and condensation barrier 236 generally comprises a rubberized material that can be sprayed, painted or otherwise coated onto the wood board for the subfloor 238. The moisture and condensation barrier 236 can then be allowed to dry or cure to form a flexible non-tacky solid that is permanently attached to the wood board, is resistant to penetration by water, is durable and not subject to degradation when exposed to water and/or to heating/cooling cycles (e.g. freeze/thaw cycles) and can allow nails and staples to pass through in order to affix the wood board for the subfloor 238 to other components of the building structure 234, if needed. That product commonly referenced by the trade name "Dynatron (™) Dyna-Pro Rubberized Undercoat" (™) available from Bondo Corporation of Atlanta, Ga., is an acceptable example of such a rubberized material. Additionally, that product commonly referenced by the trade name "Mar-Hyde Paintable Rubber Undercoating" (™) available from Bondo/Mar-Hyde Corporation of Atlanta, Ga. is also an acceptable example of such a rubberized material. These rubberized undercoatings have been used effectively at a thickness of about 6–8 mils, but the actual thickness for these and other coating materials depends on the application.

The flooring system 202 is shown placed between the walls 210 above the concrete slab on grade 214 supported directly on the ground 216, similar to the embodiment shown in FIG. 2. The concrete slab on grade 214 also serves as an optional radiant heating system having the heat pipes 218 displaced throughout the concrete slab on grade 214. The same flooring system 202 with the moisture and condensation barrier 236 coated onto the wood boards of the wood subfloor 238 may also be incorporated into a building structure (not shown) not having the radiant heating system.

Figure 5:
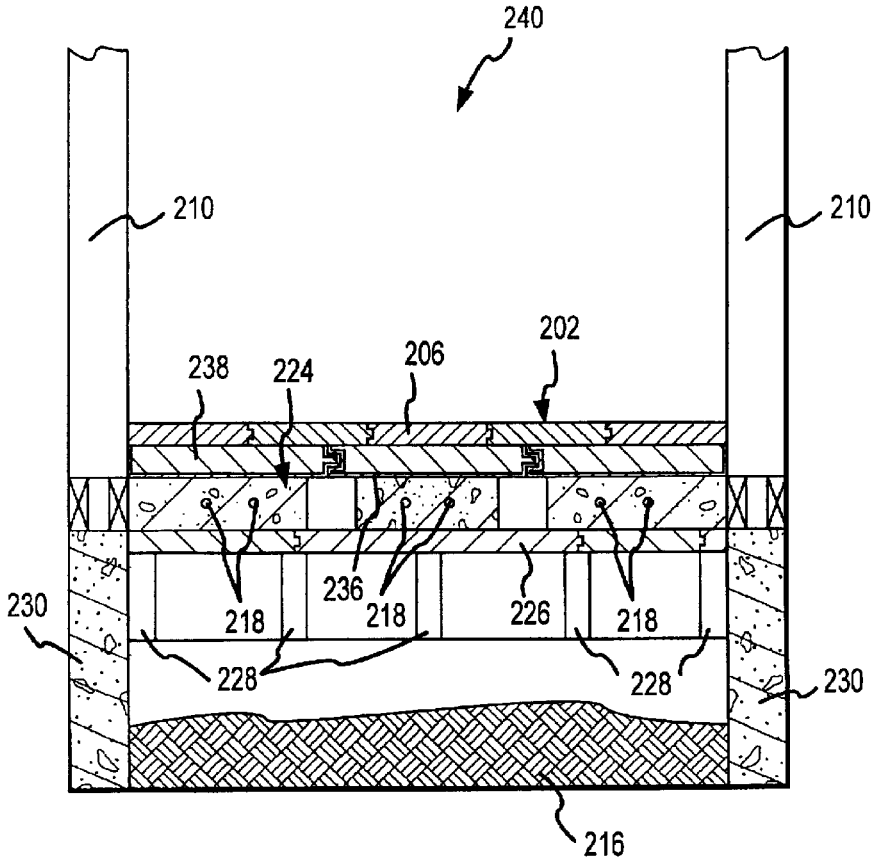
FIG. 5 is a cross sectional view of a building structure including a fourth embodiment of a flooring system according to the present invention.
Figure 6:
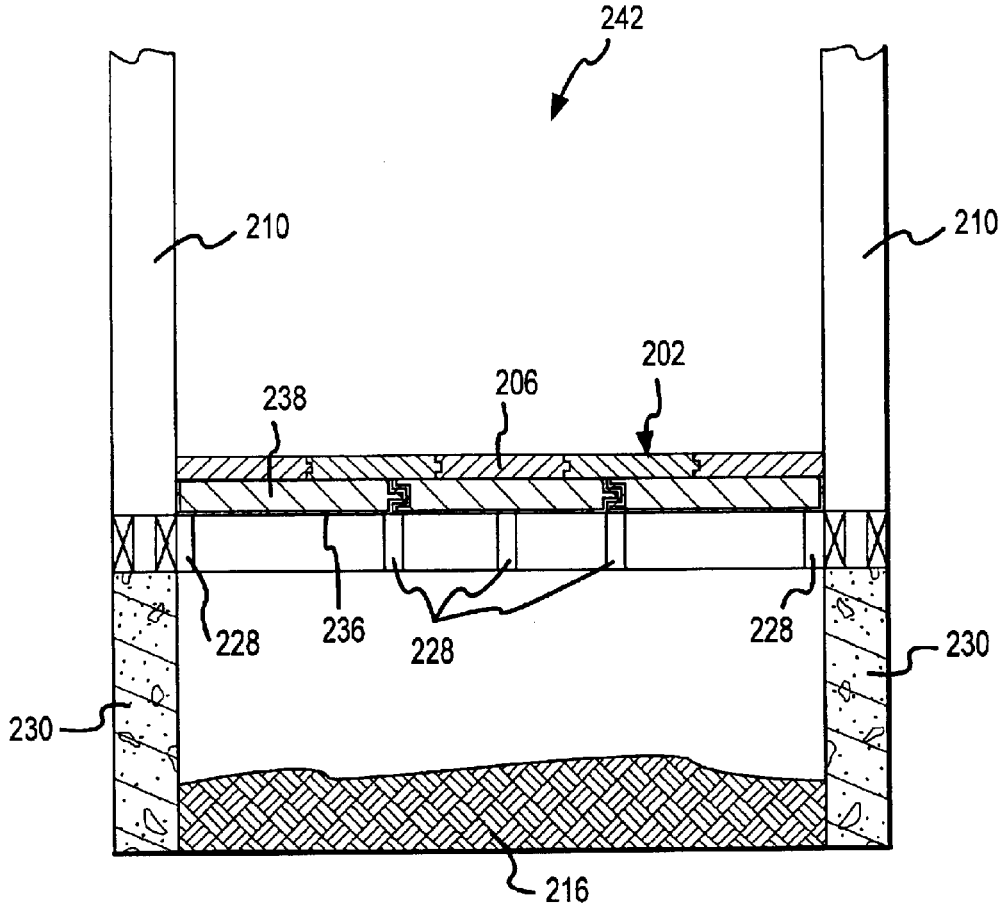
FIG. 6 is a cross sectional view of a building structure including a fifth embodiment of a flooring system according to the present invention.

Building structures 240 and 242 having fourth and fifth embodiments of the flooring system 202 including an adequate moisture and condensation barrier 236 are shown in FIGS. 5 and 6, respectively. In these embodiments, similar to the embodiment shown in FIG. 4, the moisture and condensation barrier 236 is coated onto the wood boards that form the wood subfloor 238 under the hardwood floor 206. Additionally, the flooring system 202 in both FIGS. 5 and 6 is shown placed between the walls 210. However, unlike the embodiment shown in FIG. 4, the flooring system 202 shown in FIGS. 5 and 6 are elevated above the ground 216 by the concrete slab 230 and the structural joists 228, similar to the embodiment shown in FIG. 3. The embodiment shown in FIG. 5 also includes the radiant heating system 224 (having the heat pipes 218) supported on the second wood subfloor 226 in the flooring system 202. The embodiment shown in FIG. 6, on the other hand, does not include a radiant heating system, so the wood subfloor 238 having the coated-on moisture and condensation barrier 236 is supported directly on the structural joists 228.

Figure 7:
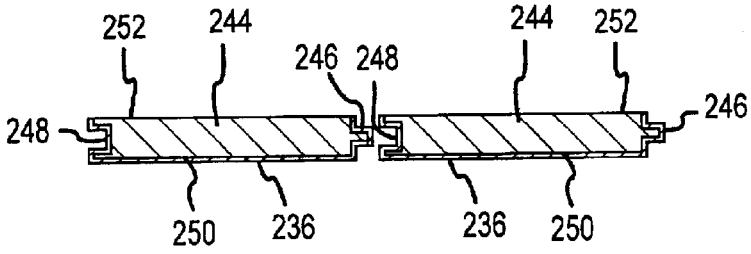
FIG. 7 is a cross sectional view of wood boards incorporated into the flooring systems shown in FIGS. 4, 5 and 6.
Figure 8:
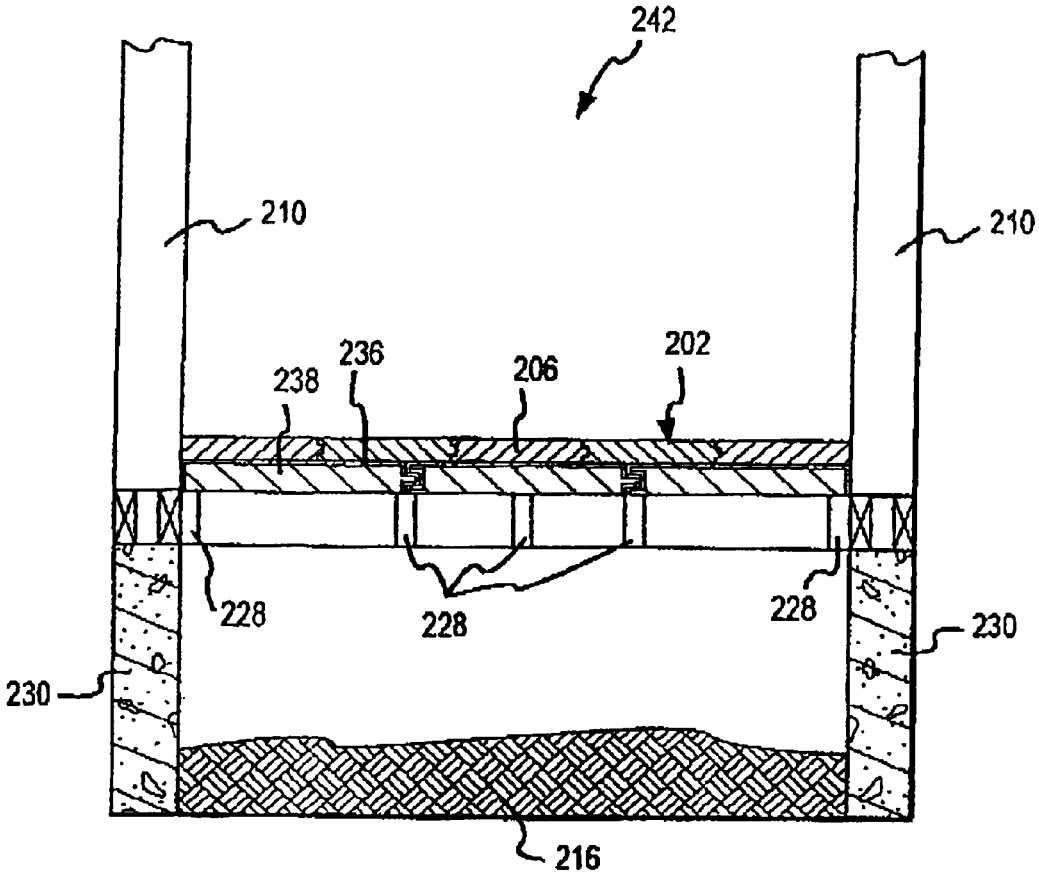
FIG. 8 is a cross sectional view of a building structure including a flooring system according to the present invention comprising a moisture barrier coated onto the top side of wood boards, with the moisture barrier facing away from moisture conditions when installed in a wood subfloor.

Wood boards 244 (such as plywood) that may be used in the wood subfloor 238 (FIGS. 4, 5 and 6) are shown in FIG. 7. The wood boards 244 generally have a tongue 246 and groove 248 construction for fitting the wood boards 244 tightly together to form the wood subfloor 238. The moisture and condensation barrier 236 may be any appropriate material that can be coated onto (e.g. by spraying, painting, pouring, troweling, etc.) the wood boards 244 when in a liquid or semi-liquid state and allowed to dry or cure in ambient environment into a flexible non-tacky solid state permanently attached to the wood board 244. In some embodiments, the moisture and condensation barrier 236 is preferably made of a rubberized coating material (as opposed to a vulcanized rubber sheet, vulcanizable rubber or rubber particles), such as the aforementioned "Dynatron Dyna-Pro Rubberized Undercoat" and "Mar-Hyde Paintable Rubber Undercoating," which are commonly used for coating concrete and steel. Other rubberized coating materials, sometimes having the rubber in solution along with methylene chloride and petroleum distillates, may also be available for use as the moisture and condensation barrier 236.

Whether it is the specifically mentioned products, the material for the moisture and condensation barrier 236 preferably does not require additional treatment, pressurizing, heating, vulcanizing or other processing steps for completing the finished coated wood boards 244. Additionally, the material generally can be rolled, squeegeed or sprayed onto the wood board 244 to a desired thickness, such as about 6–8 mils.

Figure 9:
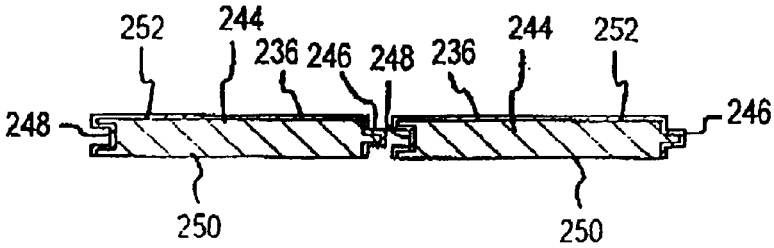
FIG. 9 is a cross sectional view of wood boards comprising a moisture and condensation barrier coated onto the ton side.
Figure 10:
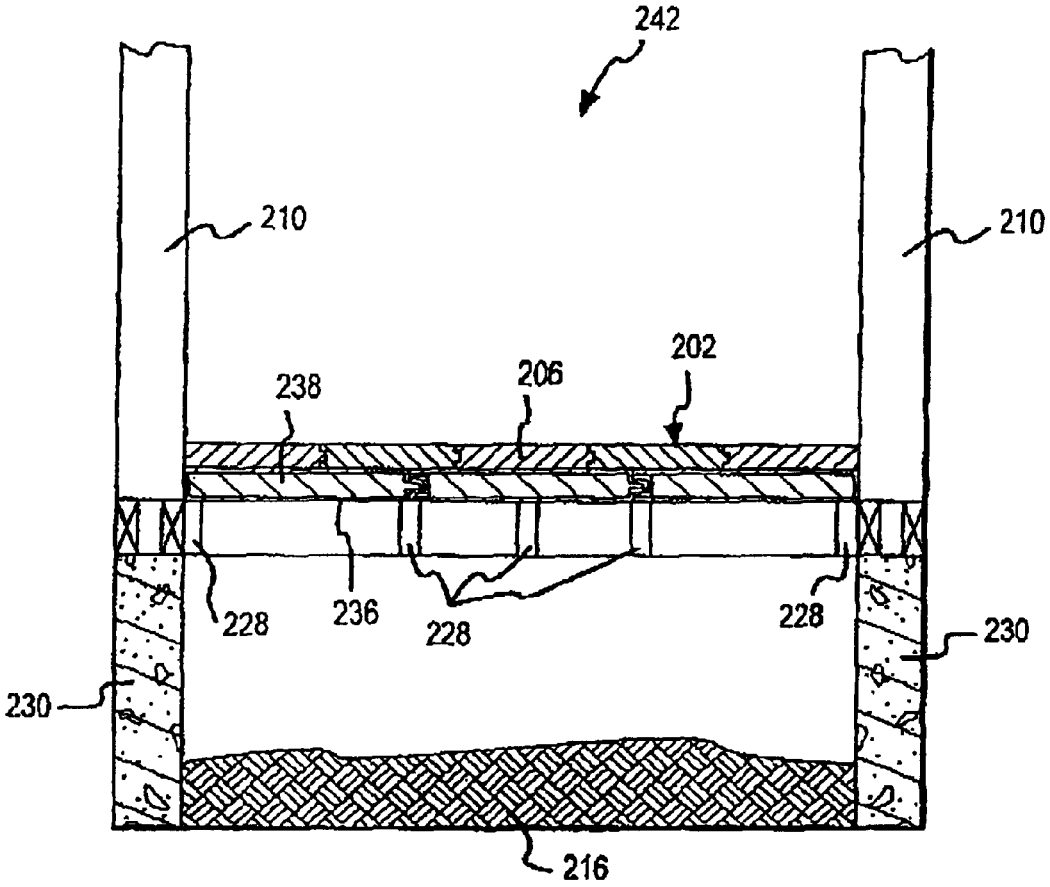
FIG. 10 is a cross sectional view of a building structure including a flooring system according to the present invention comprising a moisture and condensation barrier coated onto all sides of wood boards when installed in a wood subfloor.
Figure 11:
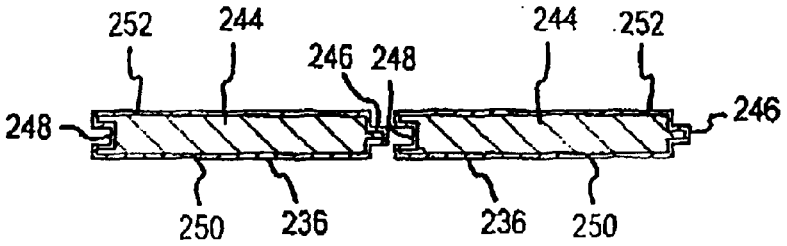
FIG. 11 is a cross sectional view of wood boards comprising a moisture and condensation barrier on all sides.

The moisture and condensation barrier 236 may be coated onto only part of the surfaces of the wood boards 244, as shown in FIGS. 6–9, or may cover the entire surfaces of the wood boards 244, as shown in FIGS. 10 and 11. Generally, the moisture and condensation barrier 236 is coated at least onto one side and the tongues 246 and grooves 248 of the wood boards 244, as shown in FIGS. 7 and 9. If coated onto only one side, the moisture and condensation barrier 236 may be either on the bottom side 250, as shown in FIG. 7, or top side 252, as shown in FIG. 9, of the wood boards 244 when installed in the wood subfloor 238 (FIGS. 4–6 and 8). Coverage of the tongues 246 and grooves 248 by the moisture and condensation barrier 236 ensures that the joints between the wood boards 244, when the tongues 246 and grooves 248 are forced together, are relatively impenetrable by moisture. Moisture-resistant tape or other joint-sealing products (not shown) are generally used to seal the joints between the wood boards 244 to further enhance the moisture impenetrability of the joints. Additionally, in some embodiments, the moisture and condensation barrier 236 is preferably coated to the wood boards 244 to form an elastomeric membrane prior to installation of the wood boards 244 in the wood subfloor 238 (such as in a factory).

An advantage of the subject matter described herein involves moisture and condensation barriers that prevent penetration by water, are quick and easy to install in a building structure (particularly in flooring systems) and do not degrade over time or when exposed to water or to frequent heating/cooling (e.g. freezing/thawing) cycles. With respect to the flooring systems (and other wood components), the moisture and condensation barriers protect the finished hardwood floor (and the wood subfloor if installed below the wood subfloor) from damage by moisture, such as warping, cracking, buckling, rotting, etc. and prevents the creation of an environment for the growth of mold, mildew and termites in or on the wood. Thus, the moisture and condensation barriers are particularly advantageous when installed in the flooring system of a building structure having a radiant heating system, since radiant heating systems exacerbate moisture problems by causing condensation around the radiant heating system.

Presently preferred embodiments of the subject matter herein and its improvements have been described with a degree of particularity. This description has been made by way of preferred example. It should be understood that the scope of the claimed subject matter is defined by the following claims, and should not be unnecessarily limited by the detailed description of the preferred embodiments set forth above.

What is claimed is:

1. A flooring system supported by a concrete slab of a building structure comprising: a wood subfloor supported by the concrete slab; a wood finished floor supported by the wood subfloor; a moisture and condensation barrier layer coated onto the wood subfloor, the moisture and condensation barrier layer comprising a non-vulcanized, cured liquid rubberized coating material having a thickness sufficient to prevent moisture and condensation from penetrating through the moisture and condensation barrier layer.

2. A flooring system as defined in claim 1 wherein the moisture and condensation barrier layer has about a 6-to-8-mil thickness of the non-vulcanized, cured liquid rubberized coating material.

3. A flooring system as defined in claim 1 further comprising: a radiant heating system supported by the concrete slab and disposed under the wood subfloor and the moisture and condensation barrier layer, the radiant heating system providing heat to the flooring system and the building structure; and wherein the moisture and condensation barrier layer prevents moisture and condensation from penetrating through the moisture and condensation barrier layer.

4. A flooring system as defined in claim 1 wherein the non-vulcanized, cured liquid rubberized coating material cures into a solid after being coated onto the wood subfloor.

5. A flooring system as defined in claim 1 wherein the wood subfloor comprises a plurality of wood boards having the non-vulcanized, cured liquid rubberized coating material coated onto the wood boards.

6. A flooring system as defined in claim 5 wherein the non-vulcanized, cured liquid rubberized coating material is coated onto only one side of the wood boards; and the wood boards are placed in the wood subfloor with the coated side face down.

7. A flooring system as defined in claim 5 wherein the non-vulcanized, cured liquid rubberized coating material is coated onto only one side of the wood boards; and the wood boards are placed in the wood subfloor with the coated side face up.

8. A method of forming a flooring system supported by a concrete slab in a building structure comprising: coating a plurality of wood boards with a moisture and condensation barrier material having a non-vulcanized, cured liquid rubberized coating material; placing the coated wood boards onto the concrete slab to form a wood subfloor having a moisture and condensation barrier that prevents moisture and condensation from penetrating through the moisture and condensation barrier; and installing a wood finished floor over the wood subfloor.

9. A method as defined in claim 8 further comprising coating the wood boards with the non-vulcanized, cured liquid rubberized coating material that cures into a non-tacky solid to form the moisture and condensation barrier material.

10. A method as defined in claim 8 further comprising: before placing the coated wood boards onto the concrete slab, installing a radiant heating system onto the concrete slab, the radiant heating system being for heating the flooring system and the building structure; and placing the coated wood boards over the radiant heating system to prevent moisture and condensation from reaching the wood finished floor from the radiant heating system.

11. A method as defined in claim 8 further comprising: coating only one side of each wood board; and placing the wood boards onto the concrete slab with the one coated side face down to prevent moisture and condensation from penetrating through the moisture and condensation barrier to the wood subfloor and wood finished floor.

12. A method as defined in claim 8 further comprising: coating only one side of each wood board; and placing the wood boards onto the concrete slab with the one coated side face up to prevent moisture and condensation from penetrating through the moisture and condensation barrier to the wood finished floor.

* * * * *